US006635991B1

(12) United States Patent
Bakker et al.

(10) Patent No.: US 6,635,991 B1
(45) Date of Patent: Oct. 21, 2003

(54) METHOD OF ADJUSTING THE LIGHT SPECTRUM OF A GAS DISCHARGE LAMP, GAS DISCHARGE LAMP, AND LUMINAIRE FOR SAID LAMP

(75) Inventors: Levinus P. Bakker, Utrecht (NL); Gerardus M. W. Kroesen, Utrecht (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/396,563

(22) Filed: Sep. 15, 1999

(30) Foreign Application Priority Data

Sep. 16, 1998 (NL) ..... 1010101

(51) Int. Cl.[7] ..... H01J 17/22; H01J 17/36; H01J 61/12

(52) U.S. Cl. ..... 313/568; 313/483; 313/564; 313/571; 315/112; 315/117; 315/291; 315/307

(58) Field of Search ..... 313/568, 565, 313/564, 571, 570, 639, 483–487; 315/169.1, 291, 307, 112, 117, 246, 248

(56) References Cited

U.S. PATENT DOCUMENTS 1,792,347 A * 2/1931 Zecher
4,529,912 A * 7/1985 Northrup et al. ..... 250/205
4,746,832 A * 5/1988 Grossman et al. ..... 313/22
4,996,465 A * 2/1991 Uetsuki ..... 315/358
5,034,661 A * 7/1991 Sakurai et al. ..... 315/207
5,243,261 A * 9/1993 Bergervoet et al. ..... 315/224
5,363,019 A * 11/1994 Itatani et al. ..... 315/169.1
5,410,216 A * 4/1995 Kimoto et al. ..... 313/485
5,592,052 A * 1/1997 Maya et al. ..... 315/291
5,909,085 A * 6/1999 Nelson ..... 315/94
6,034,471 A * 3/2000 Jennato et al. ..... 313/485
6,274,986 B1 * 8/2001 Devonshire et al. ..... 315/291
6,353,289 B1 * 3/2002 Ishigami et al. ..... 313/568

FOREIGN PATENT DOCUMENTS

JP 06310099 * 11/1994 ..... H01J/61/38

* cited by examiner

*Primary Examiner*—Ashok Patel
*Assistant Examiner*—Sikha Roy

(57) ABSTRACT

The invention relates to a method of adjusting a desired spectrum of light emitted by a gas discharge lamp during its operation, said gas discharge lamp comprising a first ionizable substance and a second substance which is less readily ionizable than the first substance. According to the invention, the gas discharge lamp is operated such that gases of both substances cans be excited, while the partial pressure of the first substance is adjusted in dependence on the desired spectrum. For this purpose, for example, the current through the lamp may be modulated. In an alternative embodiment, this is suitably achieved in that the partial mercury pressure is varied, for example through an adjustment of the temperature of a mercury amalgam present in the gas discharge lamp. The invention also relates to a gas discharge lamp whose color can be varied during its operation, and to a luminaire provided with a supply for such a lamp.

31 Claims, 2 Drawing Sheets

METHOD OF ADJUSTING THE LIGHT SPECTRUM OF A GAS DISCHARGE LAMP, GAS DISCHARGE LAMP, AND LUMINAIRE FOR SAID LAMP

BACKGROUND OF THE INVENTION

The invention relates to a method of adjusting a desired spectrum of the light emitted by a gas discharge lamp during its operation, wherein the gas discharge lamp comprises a discharge chamber closed in a gastight manner with a first ionizable substance and a second substance less readily ionizable than said first substance both present in the discharge chamber, at least a portion of the first and of the second substance being in the gas state during operation, and which gas discharge lamp is operated under mm voltage and current conditions such that at least the gas of the first substance can be ionized and the second substance can be excited.

It is known to adjust the spectrum of the light emitted by a finished gas discharge lamp during its operation. The lamp is operated for this purpose by means of very short pulses of high power. The pulsatory character (with pulse durations of the order of 1 microsecond) makes the electron temperature very high, so that the less readily ionizable gaseous substance, for example neon, is excited and starts contributing to the spectrum.

Such a method has the disadvantage that a comparatively expensive electronic circuit is required for generating the high-power pulses of very short duration.

SUMMARY OF THE INVENTION

According to the invention the ratio of i) the partial pressure of the first substance to ii) the partial pressure of the second substance is adjusted in dependence on the desired spectrum.

It was found that the modification of the ratio of the partial pressures renders it possible to adjust the spectrum. The ratio between i) the intensity integrated over a wavelength range which is a fraction of the wavelength range of the full desired spectrum and ii) the intensity integrated over the wavelength range of the entire desired spectrum is changed thereby. Both the first substance and the second substance contribute to the spectrum by the emission of light. It has long been generally known that an energy-saving lamp positioned outside in winter shows a color deviation at least during starting as a result of the temperature conditions and accompanying lower partial mercury pressure, but no proposals for adjusting the spectrum of the light of a gas discharge lamp as desired are as yet known to Applicant which involve the modification of the partial pressure of a gas present in the gas discharge lamp. It depends on the application what a desired spectrum will be. The wavelength range of the desired spectrum will correspond to the wavelength range which plays a part in light-dependent physiological processes in the case of lamps used in greenhouses. The use of lamps for illuminating a human domestic or professional ambience requires a wavelength range to which the human eye is sensitive. It is noted here that, if luminescent substances are used, it will be clear to those skilled in the art that a desired wavelength range as mentioned above is derived from a desired wavelength range with which the luminescent substances can be suitably excited. The following definitions are used in the present application. The term 'reference pressure' is understood to mean the partial pressure which prevails in a non-operating gas discharge lamp when this lamp has a temperature equal to the temperature of the portion of the lamp which defines the pressure of the first substance.in the situation in which the lamp is on (this is usually the coldest spot in the discharge space of the lamp) while the lamp is operated at an ambient temperature of 25° C. Under these conditions, that portion of the first substance which is in the gas state is distributed at least substantially homogeneously in the cavity of the lamp's discharge chamber. The reference pressure serves as a measure for indicating how much of a certain substance should be present in the gas state for a functional gas discharge lamp. As will be explained further below, the concentration of the first substance may differ locally during operation of the gas discharge lamp. In that case, the term 'local partial pressure' will be used for the relevant location. The essence of the present invention is that the local partial pressures are adjusted in that portion of the discharge lamp where the discharge takes place, i.e. in the discharge space. Where the 'partial pressure' is referred to without further particulars herein, the local partial pressure such as prevails in the center of the discharge space is meant, the center being that portion of the discharge space which lies farthest away from the wall. The first substance and the second substance differ from one another by their different emission spectra. Small differences may be sufficient in the case of luminescent materials, such as phosphors, provided luminescent materials are used which have different sensitivities to the two mutually resembling emission spectra. Usually, the pressure of the gas mixture in the lamp will be between 10 and 10,000 Pa. The second, less readily ionizable substance will usually be present in excess quantity compared with the first substance. The ambient temperature will generally be at least 15° C.

Advantageously, the ratio of the partial pressures is modified such that the ratio of i) the intensity integrated over a wavelength range which is a fraction of the wavelength range covering the full desired spectrum to ii) the intensity integrated over the wavelength range of the full desired spectrum is changed by at least 3% with respect to a preset value.

The modification by at least 3% renders possible a change which is subjectively observable for a user. The emission spectrum is defined as the emission spectrum as it can be measured at the inside wall of a gas discharge lamp.

In a major embodiment, a gas discharge lamp provided with a luminescent material is utilized, and one of the substances in the gas state emits visible light having a first spectrum while another substance in the gas state emits UV radiation, which UV radiation excites the luminescent material so as to emit visible light having a second spectrum different from the first spectrum.

The emission of visible light renders it possible to achieve a modified spectrum without a further luminescent material being necessary for this in addition to the luminescent material necessary for converting UV radiation into visible light.

Advantageously, a rare gas is used as the second substance, in particular neon or xenon. Mercury is suitable for use as the first substance.

Such substances are highly suitable for operating the gas discharge lamp according to the invention. In particular, neon renders it possible to change the proportion of red light through direct emission. Xenon is interesting because of its UV emission spectrum which is different from that of mercury, so that it can be used in combination with mercury. Mercury is interesting as the first substance because its partial pressure can be adjusted by means of a gas/liquid or gas/solid phase transition.

Advantageously, therefore, in order to modify the partial mercury pressure, the gas discharge lamp is provided with liquid mercury or an amalgam, the temperature of which is adjusted for adjusting the ratio of i) the partial mercury pressure to ii) the partial pressure of the second substance.

The reference pressure of mercury can thus be modified in a simple and inexpensive manner (by means of a gas/liquid or, in the case of an amalgam, a gas/solid phase transition), and accordingly also the local partial mercury pressure and the spectrum of the light of the gas discharge lamp.

In an interesting embodiment, the temperature of the gastight sealing wall of the discharge chamber is adjusted by electric cooling and/or heating means which are in heat-conducting contact with the wall.

The cooling and/or heating means may be suitably chosen from i) a current resistor provided on at least a portion of the wall of the gas discharge chamber and ii) a Peltier element. The current resistor may be, for example, a current-conducting coating, such as a tin oxide coating, provided on the inner or outer wall of the discharge chamber. It can be achieved thereby that mercury deposited on the inner wall of the gas discharge lamp is returned to the gas state again through a rise in temperature. As was described above, this results in an increase in the partial mercury pressure and finally in a change in the spectrum of the gas discharge lamp. The use of a Peltier element renders it possible to cool or heat, as desired. Thus it is possible not only to raise the partial pressure, but also to lower it quickly as compared with a non-forced cooling.

In a major embodiment of the method according to the invention, the current supplied to the gas discharge lamp is controlled for the modification of the ratio of the partial pressures.

Increasing the current increases the chance of ionization. The difference in diffusion speed between electrons and ions promotes an outward force exerted on the positively charged ions, i.e. in the direction of the inner wall of the gas discharge lamp. Positively charged ions are neutralized at the inner wall and diffuse slowly back into the cavity of the discharge chamber of the lamp. The difference in diffusion speed between a neutral particle and its excited counterpart renders it possible to vary the local partial pressure of the first substance in the gas phase, such as mercury, through the change in the ratio of these particles (radial cataphoresis under the influence of ambipolar diffusion).

The gas discharge lamp may be operated on an alternating current or a direct current, as desired, the alternating current or direct current being modulated as described below. The amplitude of the alternating or direct current is suitably varied with a modulation frequency of between 25 and 2,000 Hz, preferably between 75 and 2,000 Hz, and there is a first cycle portion in which the power is higher than the average power and a second cycle portion in which the power is lower than the average power, with the condition that both cycle portions should have a duration of at least 250 microseconds.

It is thus possible to change the luminous flux of the lamp and the color of the lamp independently of one another in that the modulation method (i.e. the modulation frequency, the ratio between the lengths of said first and second cycle portions, and the ratio between the power in the first cycle portion and the average power) of the current and the amplitude of the current through the lamp are changed. Typically, the reference pressure of mercury is below 10 Pa and the lamp is operated with a current density of between $10^{-3}$ and 50 mA/mm$^2$, preferably between 0.20 and 5 Pa and between 0.01 and 20 mA/mm$^2$. The current density is defined here as the total current strength divided by the surface area of a cross-section of the tube in a plane perpendicular to the longitudinal direction of the discharge cavity. If neon is used as the second substance, a suitable mercury pressure is between 0.2 and 0.9 Pa, the neon pressure is between 100 and 3,000 Pa, and the current density is between 0.1 and 7 mA/mm$^2$.

The invention also relates to a gas discharge lamp which comprises a discharge chamber which is closed in a gastight manner with a first ionizable substance and a second substance less readily ionizable than the first substance in the discharge chamber, while at least a portion of the first and the second substance are capable of being in the gas phase during operation.

According to the invention, the gas discharge lamp is provided with means for modifying the ratio of the partial pressures of the gases with respect to a preset value.

The spectrum of the light emitted during operation by such a gas discharge lamp can be adjusted as desired.

In an important embodiment, said means are chosen from i) a means for controlling the temperature and ii) a control device (shown schematically as reference no. 5 in FIG. 1) for controlling the current through the discharge chamber

- with a modulation frequency of between 25 and 2,000 Hz, preferably between 75 and 2,000 Hz; and
- with a first cycle portion, in FIG. 4 reference no. 8, in which the power is higher than the average power and a second cycle portion 9 in which the power is lower than the average power, with the condition that both cycle portions should have a duration of at least 250 microseconds.

Given such means, it is simple to adjust the spectrum. Means for controlling the temperature may be present inside or outside the gas discharge lamp, as desired. In the latter case, they may be separate from or fixedly connected to the gas discharge lamp.

In a favorable embodiment, the means for controlling the temperature are formed by a Peltier element (shown schematically as reference no. 6 in FIG. 1).

A Peltier element is capable of heating or cooling, as desired. It is thus possible not only to raise, but also to lower the partial pressure, such as the mercury pressure. The Peltier element preferably controls the temperature in that portion of the discharge chamber which defines the partial pressure of the first substance during operation, preferably in the location of the first substance such as mercury or an amalgam.

In an alternative embodiment, the means for controlling the temperature are formed by a current resistor (shown schematically as reference no. 7 in FIG. 1), suitably one which is in heat-conducting contact with the inner wall of the gas discharge lamp. In an interesting embodiment, the current resistor is a light-transmitting coating, such as a tin oxide coating.

It is thus possible to raise the temperature of the lamp in a simple manner. Again, the current resistor is preferably present in that portion of the gas discharge chamber where the partial pressure of the first substance is defined during operation. The coating may be provided on the inside and/or on the outside of the discharge chamber.

In an embodiment which can be realized in a simple manner, the gas discharge lamp provided with means for controlling the temperature further comprises liquid mercury or an amalgam whose temperature can be controlled by said means and which is in communication with, and is preferably present in the discharge chamber.

A typical gas discharge lamp according to the invention comprises mercury or an amalgam as the first substance and neon as the second substance, the reference pressure of mercury being at most 10 Pa and the reference pressure of neon being at most $10^4$ Pa, in particular a lamp in which the reference pressure of mercury is between 0.20 and 5 Pa and the reference pressure of neon between 100 and 3,000 Pa.

A special embodiment of the gas discharge lamp according to the invention is characterized in that the first substance in the gas phase and the second substance in the gas phase emit mainly radiation in the UV range during operation, with a first spectrum and a second spectrum differing from the first, respectively, and in that the gas discharge lamp comprises a first luminescent material and a second luminescent material. The luminescent materials upon excitation both emit visible light but with different spectra, the first luminescent material having a comparatively high sensitivity to the UV radiation having the first spectrum, and the second luminescent material having a relatively increased sensitivity to the UV radiation having the second spectrum.

Both substances in such a gas discharge lamp emit mainly UV radiation in the gas phase, but at different wavelengths. The luminescent materials ensure that the gas discharge lamp can emit light having a variable spectrum thanks to their different sensitivities to these wavelengths.

Finally, the invention relates to a luminaire for a gas discharge lamp provided with a supply unit comprising a circuit for controlling a current chosen from the group comprising i) a direct current and ii) an alternating current with a modulation frequency which can be adjusted by a user as desired between 25 and 2,000 Hz, preferably between 75 and 2,000 Hz; and with a first cycle portion in which the power is higher than the average power and a second cycle portion in which the power is lower than the average power, with the condition that both cycle portions should have a duration of at least 250 microseconds.

Such a supply unit is highly suitable for adjusting the spectrum of a gas discharge lamp by a user, which gas discharge lamp comprises a discharge chamber sealed in a gastight manner with a first ionizable substance, such as mercury, and a second less readily ionizable substance than the first, such as neon, being present in the discharge chamber, while at least part of the first and of the second substance is in the gas phase during operation.

An alternative luminaire may be provided with means for controlling the temperature of at least part of the gas discharge lamp. Such means comprise, for example, a Peltier element or a current resistor and may be provided with a member for measuring the temperature, in particular the temperature of the surroundings of the gas discharge lamp.

DETAILED DESCRIPTION OF THE PREFERRED EMBODIMENT

Figure 1:
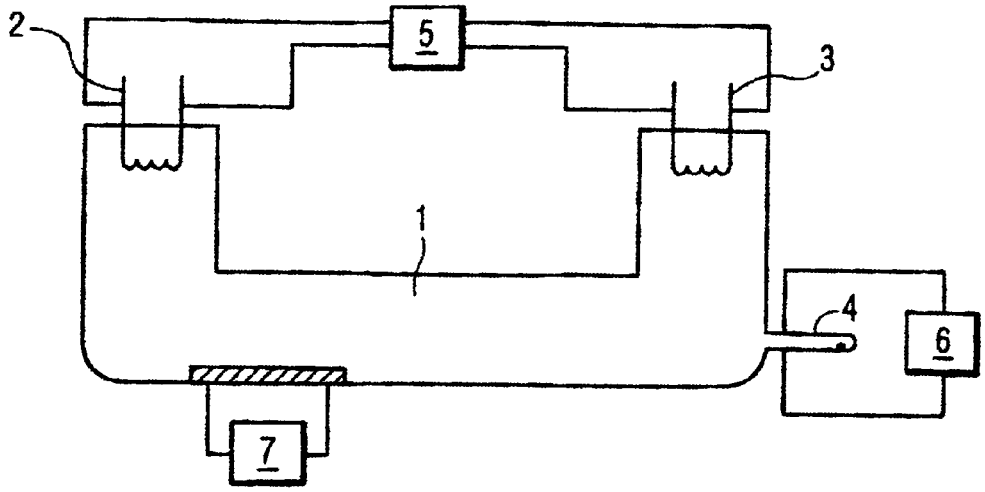
FIG. 1 is a diagram representing an experimental gas discharge lamp.

A U-shaped tube was provided with a 4,000 K triphosphor coating comprising the phosphors YOX, CBT, and BAM (Philips, Eindhoven, Netherlands), filled with 1,500 Pa neon. 90 mg BiIn amalgam was provided in an auxiliary tube 4 which was in communication with the cavity of the discharge chamber 1 of the tube. The internal diameter of the lamp was 24 mm, and the spacing between electrode 2 and electrode 3 was 15 cm.

The U-shaped lamp was suspended in a temperature-controlled bath, such that the electrodes 2 and 3 remained above water and the auxiliary tube 4 was in the water.

The lamp was connected in series with a 200 nF capacitor and connected to an ENI Plasmaloc 1-HF supply (ENI Power Systems Inc., Rochester, N.Y., USA). The supply was in the form of a sinusoidal voltage with a frequency of 90 kHz.

An optical multichannel analyzer capable of measuring the entire visible spectrum in one operation was used for ascertaining the effect of various parameters on the spectrum of the light emitted by the gas discharge lamp.

Measurements were carried out at a number of different water temperatures so as to vary the mercury pressure in the lamp.

The lamp spectrum was measured for different connected powers, starting from 10 W and rising in steps of approximately 5 W. The photometrical output (luminous flux F), the color coordinates x and y, and the correlated color temperature Tc were calculated from the measured lamp spectrum each time.

Figure 3:
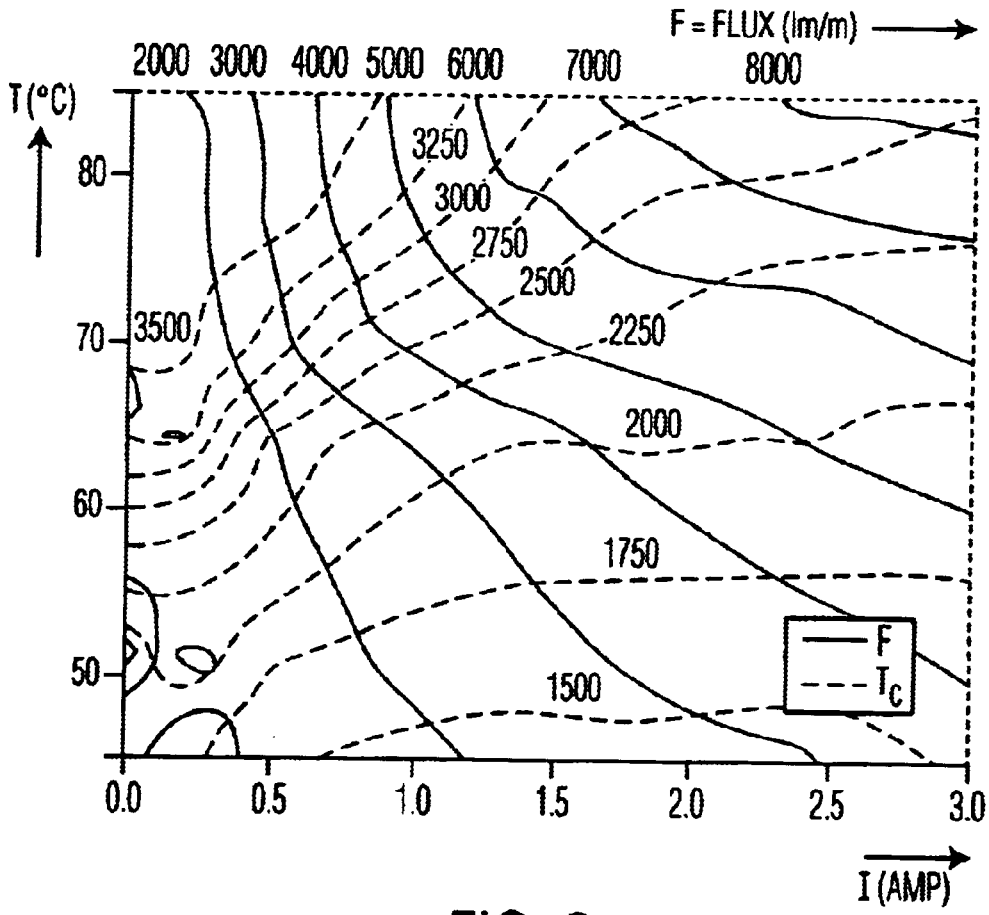
Figure 4:
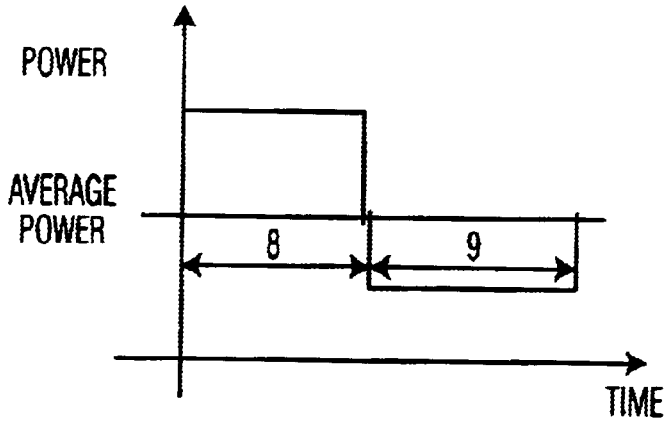
FIG. 4 is a diagram representing the variation in power applied across the discharge (y-axis) over time (x-axis).

FIG. 3 shows the collected data in the form of a graph. It is apparent therefrom that the correlated color temperature Tc of the lamp becomes lower at higher currents I or lower amalgam temperatures.

Figure 2:
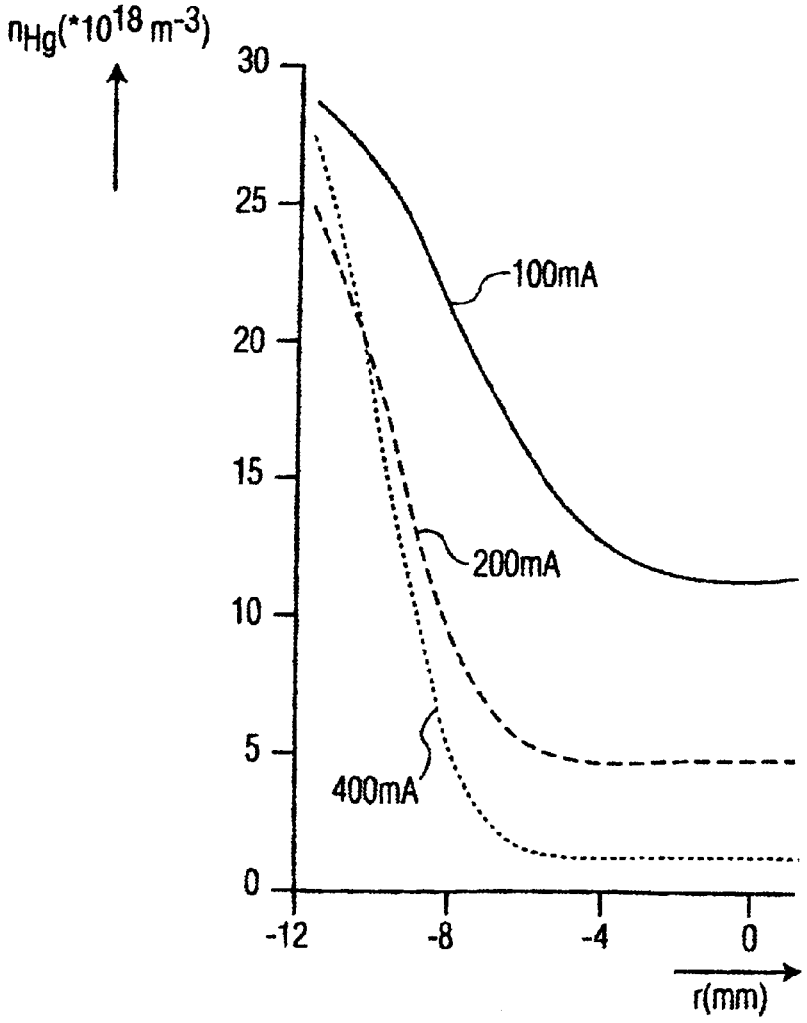
FIG. 2 shows the mercury density as a function of the distance from the lamp axis for various lamp currents, and FIG. 3 graphically shows the influence of the temperature and of the current through the experimental gas discharge lamp on the color of the emitted light.

In a second series of experiments, the lamp was supplied with a 50 kHz alternating current, which was modulated at a lower frequency. The lamp was supplied with a power higher than the average power in a first portion of each modulation cycle, whereas the lamp was supplied with a power lower than the average power in a second portion of each modulation cycle. FIG. 2 clearly shows that the mercury density as a function of the radius of the lamp vessel is strongly dependent on the lamp current, i.e. on the lamp power. The distribution of the mercury density over the lamp vessel in its turn strongly influences the color of the light generated by the lamp. As a result of this, the color of the light radiated by the lamp in the first portion of a modulation cycle differs from the color radiated in the second portion of the modulation cycle. Provided the modulation frequency is high enough, the human eye will register light with a color which is a mixture of the two colors radiated by the lamp in succession in one cycle.

The lamp current was generated by means of a Spitzenberger and Spies EV 600/C power amplifier and a UT 600/G transformer in the second series of experiments. The input voltage of the Spitzenberger amplifier was generated by a Philips waveform generator PM 5190 connected to a Philips pulse generator PM 5716. The PM 5716 pulse generator modulates the amplitude of the output voltage of the waveform generator PM 5190 and thus determines the duty cycle of the modulation. Integrated lamp power was measured with a Norma AC/DC power analyzer D5235. The lamp voltage Vlamp was measured by means of a Fluke PM 3384A oscilloscope. Lamp current Ilamp was measured with a Philips PM 9355 AC current probe 0.5 V/A connected to the same Fluke oscilloscope. Light output and color coordinates of the light were measured with a LMT colormeter C1210.

It was found that the color temperature of the light generated by the lamp could be adjusted over a wide range by adjusting the modulation frequency, i.e. the power supplied to the lamp during the first portion of each cycle and the second portion of each cycle, as well as the durations of these first and second portions. This was found to be the case even when the light output of the lamp was maintained at an approximately constant level.

What is claimed is:

1. A method of adjusting a desired spectrum of the light emitted by a gas discharge lamp during its operation, wherein the gas discharge lamp comprises a discharge chamber closed in a gastight manner with a first ionizable substance and a second substance less readily ionizable than said first substance both present in the discharge chamber, at least a portion of the first and of the second substance being in the gas state during operation, and which gas discharge lamp is operated under voltage and current conditions such that at least the gas of the first substance can be ionized and the second substance can be excited, the ratio of i) the partial pressure of the first substance to ii) the partial pressure of the second substance being adjusted in dependence on the desired spectrum, one of said substances in the gas state directly emitting visible light under said voltage and current conditions.

2. A method as claimed in claim 1, wherein, the ratio of the partial pressures is modified such that the ratio of i) the intensity integrated over a wavelength range which is a fraction of the wavelength range covering the full desired spectrum to ii) the intensity integrated over the wavelength range of the full desired spectrum is changed by at least 3% with respect to a preset value.

3. A method as claimed in claim 1 wherein the discharge chamber is provided with coating comprising a luminescent material, said one of the substances in the gas state directly emitting visible light having a first spectrum while another substance in the gas state emits UV radiation, which UV radiation excites the luminescent material so as to emit another visible light having a second spectrum different from the first spectrum.

4. A method as claimed in claim 1 wherein the second substance is a noble gas.

5. A method as claimed in claim 4, wherein the noble gas is neon or xenon.

6. A method as claimed in claim 1 wherein the first substance is mercury.

7. A method as claimed in claim 6 wherein the gas discharge lamp further comprises liquid mercury or an amalgam, the temperature of which is adjusted for adjusting the ratio of i) the partial mercury,pressure to ii) the partial pressure of the second substance.

8. A method as claimed in claim 6 wherein the temperature of the gastight sealing wall of the discharge chamber is adjusted by electric cooling and/or heating means which are in heat-conducting contact with said wall.

9. A method as claimed in claim 1 wherein the current supplied to the gas discharge lamp is controlled for the modification of the ratio of the partial pressures.

10. A method as claimed in claim 9, wherein the current is varied with a modulation frequency of between 25 and 2,000 Hz and in that there is a first cycle portion in which the power is higher than the average power and a s second cycle portion in which the power is lower than the average power, with the condition that both cycle portions should have a duration of at least 250 microseconds.

11. A method as claimed in claim 9 wherein the reference pressure of mercury is below 10 Pa, and the lamp is operated at a current density of between $10^{-3}$ and 50 mA/mm$^2$.

12. A method as claimed in claim 11, wherein the reference pressure of mercury is between 0.20 and 5 Pa and the lamp is operated at a current density of between 0.01 and 20 mA/mm$^2$.

13. A gas discharge lamp which comprises a discharge chamber which is closed in a gastight manner with a first ionizable substance and a second substance less readily ionizable than said first substance in the discharge chamber, while at least a portion of the first and the second substance are capable of being in the gas phase during operation, the gas discharge lamp being provided with means for modifying the ratio of the partial pressures of the light-emitting gases with respect to a preset value, one of said substances in the gas state directly emitting visible light during operation of the lamp at said preset value.

14. A gas discharge lamp as claimed in claim 13, wherein said means are chosen from i) a means for controlling the temperature and ii) a control device for controlling the current through the discharge chamber with a modulation frequency of between 25 and 2,000 Hz; and with a first cycle portion in which the power is higher than the average power and a second cycle portion in which the power is lower than the average power, with the condition that both cycle portions should have a duration of at least 250 microseconds.

15. A gas discharge lamp as claimed in claim 14, wherein the means for controlling the temperature comprises a Peltier element.

16. A gas discharge lamp as claimed in claim 14, wherein the means for controlling the temperature comprises a current resistor which is in heat-conducting contact with the inner wall of the discharge chamber.

17. A gas discharge lamp as claimed in claim 16, wherein the current resistor is a light-transmitting coating.

18. A gas discharge lamp as claimed in claim 14 wherein the gas discharge lamp further comprises liquid mercury or an amalgam whose temperature can be controlled by said means for controlling the temperature and which is in communication with the discharge chamber.

19. A gas discharge lamp as claimed in claim 14 wherein the gas discharge lamp comprises mercury or an amalgam as the first substance and neon as the second substance, the reference pressure of mercury being at most 10 pa and the reference pressure of neon being at most $10^4$ Pa.

20. A gas discharge lamp as claimed in claim 19, wherein the reference pressure of mercury is between 0.20 and 5 Pa and the reference pressure of neon is between 100 and 3,000 Pa.

21. A gas discharge lamp as claimed in claim 13 wherein the first substance in the gas phase and the second substance in the gas phase emit mainly radiation in the UV range during operation, with a first spectrum and a second spectrum differing from the first, respectively, and the gas discharge lamp comprises a first luminescent material and a second luminescent material, which luminescent materials upon excitation both emit visible light but with different spectra, the first luminescent material having a comparatively high sensitivity to the UV radiation having the first spectrum, and the second luminescent material having a relatively increased sensitivity to the UV radiation having the second spectrum.

22. A gas discharge lamp as claimed in claim 21, wherein the first substance comprises mercury and the second substance comprises xenon.

23. A luminaire for a gas discharge lamp is provided with a means for modifying the ratio of the partial pressures of the light-emitting gases with respect to a preset value comprising a supply unit having a circuit for controlling a current chosen from a group comprising i) a direct current and ii) an alternating current with a modulation frequency which can be adjusted between 25 and 2,000 Hz; and with a first cycle portion in which the power is higher than the average power and a second cycle portion in which the power is lower than the average power with both cycle portions having a duration of at least 250 microseconds.

24. A luminaire as claimed in claim 23, wherein the modulation frequency is between 75 and 2,000 Hz.

25. A method as claimed in claim 10, wherein the modulation frequency is between 75 and 2,000 Hz.

26. A gas discharge lamp as claimed in claim 14, wherein the modulation frequency is between 75 and 2,000 Hz.

27. A method of adjusting a desired spectrum of the light emitted by a gas discharge lamp during its operation, wherein the gas discharge lamp comprises a discharge chamber closed in a gastight manner with a first ionizable substance and a second substance less readily ionizable than said first substance both present in the discharge chamber, at least a portion of the first and of the second substance being in the gas state during operation, and the gas discharge lamp having no more than a first and a second electrode, said first and second electrodes applying a single electric field to the first and second substances and being operated under voltage and current conditions such that at least the gas of the first substance can be ionized and the second substance can be excited, the ratio of i) the partial pressure of the first substance to ii) the partial pressure of the second substance being adjusted in dependence on the desired spectrum.

28. A gas discharge lamp which comprises a discharge chamber which is closed in a gastight manner with a first ionizable substance and a second substance less readily ionizable than said first substance in the discharge chamber, while at least a portion of the first and the second substance are capable of being in the gas phase during operation, and electrodes consisting of a first electrode and a second electrode, said first and second electrodes applying a single electric field in the discharge chamber, the gas discharge lamp being provided with means for modifying the ratio of the partial pressures of the light-emitting gases with respect to a preset value.

29. A method of configuring a gas discharge lamp to emit light of a desired color and a desired luminous flux, comprising:

selecting a first ionizable substance and a second ionizable substance, the second ionizable substance being less readily ionizable than said first ionizable substance and at least a portion of the first and of the second ionizable substance being capable of being in the gas state during operation of said discharge lamp;

filling a discharge chamber with the first ionizable substance and the second ionizable substance, the discharge chamber comprising at least one electrode receiving a lamp current;

closing said discharge chamber in a gastight manner;

operating the gas discharge lamp under voltage and current conditions such that at least the gas of the first substance can be ionized and the second ionizable substance can be excited;

adjusting the ratio of i) the partial pressure of the first substance to ii) the partial pressure of the second substance by setting the lamp current through the discharge chamber at a modulation frequency between 25 and 2,000 Hz, with a first cycle portion in which the power is higher than the average power and a second cycle portion in which the power is lower than the average power, and with both cycle portions having a duration of at least 250 microseconds.

30. A gas discharge lamp comprising:

a discharge chamber which is closed in a gastight manner with a first ionizable substance and a second substance less readily ionizable than said first substance in the discharge chamber, at least a portion of the first and the second substance being capable of being in the gas phase during operation;

a supply unit comprising a circuit for controlling a current across an electrode in the discharge space;

the current having a modulation frequency which can be adjusted between 25 and 2,000 Hz; and a first cycle portion in which the power is higher than the average power and a second cycle portion in which the power is lower than the average power;

both cycle portions having a duration of at least 250 microseconds;

said modulation frequency and said average power being configured to achieve a desired ratio of the partial pressures of the first ionizable substance and the second ionizable substance during operation of the lamp and emission of light of a desired color and luminous flux.

31. A method as claimed in claim 1 wherein the discharge chamber is provided with coating consisting essentially of a luminescent material, said one of the substances in the gas state directly emitting visible light having a first spectrum while another substance in the gas state emits UV radiation, which UV radiation excites the luminescent material so as to emit another visible light having a second spectrum different from the first spectrum.

* * * * *